United States Patent [19]

Sugitani et al.

[11] 4,442,068

[45] Apr. 10, 1984

[54] HEAT RESISTANT CAST IRON-NICKEL-CHROMIUM ALLOY

[75] Inventors: Junichi Sugitani, Hirakata; Teruo Yoshimoto, Suita; Makoto Takahashi, Hirakata, all of Japan

[73] Assignee: Kubota Ltd., Osaka, Japan

[21] Appl. No.: 419,310

[22] Filed: Sep. 17, 1982

[30] Foreign Application Priority Data

Oct. 12, 1981 [JP] Japan ..... 56-162482

[51] Int. Cl.[3] ..... C22C 30/00

[52] U.S. Cl. ..... 420/584; 420/583; 420/581; 75/124

[58] Field of Search ..... 75/124 F, 124 C, 124 R, 75/128 T, 128 W, 128 N, 128 F; 420/584, 581, 583, 588, 586; 148/419, 442

[56] References Cited

U.S. PATENT DOCUMENTS

| | | | |
|---|---|---|---|
| 2,816,830 | 12/1957 | Kegerise | 75/125 |
| 3,459,539 | 8/1969 | Eiselstein et al. | 75/128 |
| 3,552,950 | 1/1971 | Rundell et al. | 75/124 FC |
| 3,826,649 | 7/1974 | Söderberg et al. | 75/124 FB |
| 4,183,774 | 1/1980 | Balleret et al. | 148/31 |
| 4,248,629 | 2/1981 | Pons et al. | 420/584 |
| 4,255,186 | 3/1981 | Rouby et al. | 75/122 |
| 4,302,247 | 11/1981 | Abe et al. | 75/122 |

FOREIGN PATENT DOCUMENTS

| | | | |
|---|---|---|---|
| 56-169755 | 12/1981 | Japan | 420/584 |

OTHER PUBLICATIONS

Stahlschlissel, 10. Auflage 1975, 10, Ed. 1974.

*Primary Examiner*—L. Dewayne Rutledge
*Assistant Examiner*—Debbie Yee
*Attorney, Agent, or Firm*—Armstrong, Nikaido, Marmelstein & Kubovcik

[57] ABSTRACT

A heat resistant cast iron-nickel-chromium alloy outstanding in creep fracture strength at high temperatures and resistance to thermal shock and to carburizing and containing the following components in the following proportions in terms of % by weight:

C: 0.3–0.6,
$O < Si \leqq 2.0$,
$O < Mn \leqq 2.0$,
Cr: 20–30,
Ni: 30–40,
W: 0.5–5.0,
N: 0.04–0.15,
B: 0.0002–0.004,
Ti: 0.04–0.50 and
$0.07 < Al \leqq 0.50$ the balance being substantially Fe.

1 Claim, No Drawings

HEAT RESISTANT CAST IRON-NICKEL-CHROMIUM ALLOY

BACKGROUND OF THE INVENTION

The present invention relates to heat resistant cast iron-nickel-chromium alloy, and more particularly to austenitic heat resistant cast iron-nickel-chromium alloy having the composition of Cr, Ni, and W which is excellent in creep fracture strength at high temperatures and in resistance to thermal impact or carburizing, with further use of the composition of N, Ti, Al and B, especially under the severe operating conditions at temperature above 1000° C.

HK 40 which is a heat resistant cast iron-nickel-chromium alloy containing Ni and Cr (25Cr-20Ni steel, see ASTM A 608) and HP materials (25Cr-35Ni steel, see ASTM A 297) have been used as materials for ethylene cracking tubes in the petrochemical industries. With the elevation of operating temperatures in recent years, it has been required to improve the high-temperature characteristics of such materials. To meet this requirement, HP materials containing W have been developed and placed into use. However, with the recent tendency toward severer operating conditions, it is desired to provide materials which are superior to such HP materials containing Nb in respect of high-temperature creep fracture strength and resistance to thermal shock or carburizing.

SUMMARY OF THE INVENTION

In view of the above demand, we have conducted intensive research on the influence of variously contained elements on the high-temperature characteristics of heat resistant cast iron-nickel-chromium alloy containing Cr, Ni and W as the essential components and found that the alloy can be remarkably improved in high-temperature creep fracture strength and resistance to thermal shock and to carburizing especially under temperature range above 1000° C., by containing N, B, Ti and Al therein. Thus this invention has been accomplished.

Stated specifically, the present invention provides a heat resistant cast iron-nickel-chromium alloy containing about 0.3 to 0.6% (by weight, the same as hereinafter) of C, up to about 2.0% of Si, up to about 2.0% of Mn, about 20 to 30% of Cr, about 30 to 40% of Ni, about 0.5 to 5.0 of W, about 0.04 to 0.15% of N, about 0.0002 to 0.004% of B, about 0.04 to 0.50% of Ti and about 0.07 to 0.50% of Al, the balance being substantially Fe.

DETAILED DESCRIPTION OF THE INVENTION

In the description to follow, the percentages are all by weight.

The heat resistant cast iron-nickel-chromium alloy of the present invention contains the following components in the following proportions in terms of % by weight:

C: 0.3–0.6,
$0<Si\leqq 2.0$,
$0<Mn\leqq 2.0$,
Cr: 20–30,
Ni: 30–40,
W: 0.5–5.0,
N: 0.04–0.15, B: 0.0002–0.004,
Ti: 0.04–0.50 and
$0.07<Al\leqq 0.50$
the balance being substantially Fe.

In the course of the research which was matured to the present invention, we have also found a heat resistant cast iron-nickel-chromium alloy containing the following components in the following proportions in terms of % by weight:

C: 0.3–0.6,
$0<Si\leqq 2.0$,
$0<Mn\leqq 2.0$,
Cr: 20–30
Ni: 30–40,
Nb+Ta: 0.3–1.5,
N: 0.04–0.15,
Ti: 0.04–0.50,
$0.07<Al\leqq 0.50$
B: 0.0002–0.004,
Fe: balance.

This heat resistant cast alloy, as containing Nb and Ta unlike the cast alloy of the invention, has more excellent creep fracture strength at high temperature than the steel of the invention.

In respect of resistance to thermal shock, the above alloy is inferior to the cast iron-nickel-chromium alloy of the invention. Under conditions in which satisfactory resistance to thermal shock is required, the cast iron-nickel-chromium alloy of this invention is preferable to be used.

The components of the cast iron-nickel-chromium alloy of the invention and the proportions of the components will be described below in detail.

C imparts good castability to cast iron-nickel-chromium alloy, forms primary carbide and is essential in giving enhanced creep fracture strength. At least about 0.3% of C is therefore required. With the increase of the amount of C, the creep fracture strength increases, but if an excess of C is present, an excess of secondary carbide will precipitate, resulting in greatly reduced toughness and impaired weldability. Thus the amount of C should not exceed about 0.6%.

Si serves as a deoxidant during melting of the components and is effective for affording improved anti-carburizing properties. However, the Si content must be up to about 2.0% or lower since an excess of Si will lead to impaired weldability.

Mn functions also as a deoxidant like Si, while S in molten steel is effectively fixed and rendered harmless by Mn, but a large amount of Mn, if present, renders the iron-nickel-chromium alloy less resistant to oxidation. The upper limit of Mn content is therefore about 2.0%.

In the presence of Ni, Cr forms an austenitic cast iron-nickel-chromium alloy structure, giving the alloy improved strength at high temperatures and increased resistance to oxidation. These effects increase with increasing Cr content. At least about 20% of Cr is used to obtain an alloy having sufficient strength and sufficient resistance to oxidation especially at high temperatures of at least about 1000° C. However, since the presence of an excess of Cr results in greatly reduced toughness after use, the upper limit of the Cr content is about 30%.

As described above, Ni, when present conjointly with Cr, forms an austenitic cast iron-nickel-chromium alloy of stabilized structure, giving the alloy improved resistance to oxidation and enhanced strength at high temperatures. To make the alloy satisfactory in oxidation resistance and strength especially at high temperatures of at least about 1000° C., at least about 30% of Ni must be used. Although these two properties improve with the increase of the Ni content, the effects level off when the Ni content exceeds about 40%, hence economically unfavorable, so that the upper limit of the Ni content is about 40%.

W contributes to the improvement of strength at high temperatures. At least about 0.5% of W is used for this purpose, but the upper limit of the W content is about 5.0% since use of larger amounts of W leads to reduced resistance to oxidation.

The alloy of this invention has the greatest feature in that it contains specified amounts of N, Ti, Al and B, in addition to the foregoing elements. These elements, when used conjointly, produce remarkably improved characteristics at high temperatures. Especially, under the use at high temperature above 1000° C., the alloy of the invention provides excellent features in creep fracture strength, resistance to thermal shock and to carburizing. This effect is not achievable if any one of N, Ti, Al and B is absent.

That is to say, Ti forms compounds such as carbide, nitride and carbonitride in combination with C and N. B and Al finely disperse and precipitate the said compounds to reinforce grain boundaries and to enhance resistance to cracking on the grain boudaries. Remarkable improvement in high temperature strength, that is, creep fracture strength and in high temperature characteristics of resistance to thermal shock is thus obtained. Furthermore, Ti contributes to remarkable improvement in anti-carburizing property owing to synergistic effect with Al.

N serves in the form of a solid solution to stabilize and reinforce the austenitic phase, forms nitride and carbonitride with Ti, etc., produces refined grains when finely dispersed in the presence of Al and B and prevents grain growth, thus contributing to the improvement of high-temperature strength and resistance to thermal shock. It is desired that the N content be at least about 0.04% to achieve these effects sufficiently. Preferably the upper limit of the N content is about 0.15% since the presence of an excess of N permits excessive precipitation of nitride and carbonitride, formation of coarse particles of nitride and carbonitride and impairment of resistance to thermal shock.

As stated above, when combining with C and N in steel, Ti forms carbide, nitride and carbonitride, thereby affording improved high-temperature strength and enhanced resistance to thermal shock. Especially Ti acts synergistically with Al, producing enhanced anti-carburizing properties. It is preferable to use at least about 0.04% of Ti to assure these effects. While improvements are achieved in creep fracture strength, resistance to thermal shock and anti-carburizing properties with the increase of the Ti content, use of a large amount of Ti results in coarse particles of precipitates, an increased amount of oxide inclusions and somewhat reduced strength. Accordingly, when high strength is essential, the upper limit of the Ti content is preferably about 0.15%. Further when the Ti content exceeds about 0.5%, greatly reduced strength will result, so that the Ti content should not exceed about 0.5% even if resistance to carburizing is critical.

Al affords improved creep fracture strength and, when present conjointly with Ti, achieves a remarkable improvement in resistance to carburizing. Preferably at least about 0.02% of Al should be used to give improved creep fracture strength. Although higher strength at high temperatures and high resistance to carburizing will result with increasing Al content, use of an excess of Al conversely leads to reduced strength. Accordingly when strength at high temperatures is essential, the upper limit of the Al content is preferably about 0.07%. However, when it is desired to obtain a steel which is comparable to conventional HP materials in high-temperature strength but has improved anti-carburizing properties, amount at least larger than about 0.07% are desirable. Nevertheless extremely decreased strength will result if the Al content exceeds about 0.5%. Accordingly, the Al content should not be higher than about 0.5%. Presence of a layer rich in Al can be detected by Electron Probe Micro Analyzer on the surface layer portion of the Ti and Al containing steel specimen for which carburizing treatment was applied. The layer rich in Al serves to a notable effect of preventing carburization.

B serves to form reinforced grain boundaries in the matrix of the alloy, prevents formation of coarse particles of Ti precipitates but permits precipitation of fine particles thereof and retards agglomeration of particles of precipitates, thereby affording improved creep fracture strength. For this purpose it is desirable to use at least about 0.0002% of B. On the other hand, use of a large amount of B does not result in a corresponding increase in strength and entails reduced weldability. Preferably, therefore, the upper limit of the B content is about 0.004%.

Impurities, such as P and S, may be present in amounts which are usually allowable for steels of the type described.

The high-temperature characteristics of the cast iron-nickel-chromium alloy of this invention will be described below in detail with reference to examples.

Cast alloys of various compositions were prepared in an induction melting furnace (in the atmosphere) and made into ingots (136 mm in outside diameter, 20 mm in wall thickness and 500 mm in length) by centrifugal casting. Table 1 shows the chemical compositions of the steel specimens thus obtained.

Of the alloy specimens listed in Table 1, Specimens No. 1 to No. 4 are according to the invention. Specimens No. 5 to No. 9 are comparison alloys, of which Specimen No. 5 is a HP material containing W (free from any one of N, Ti, Al and B), and Specimens No. 6 to No. 9 contain N, Ti, Al and B, the content of Ti or Al being outside the range specified by the invention.

Test pieces were prepared from the alloy specimens and tested for creep fracture strength, resistance to thermal shock and resistance to carburizing by the following methods.

TEST 1

Creep fracture test

According to JIS Z 2272 under the following two conditions:

(A) Temperature 1093° C., load 1.9 kgf/mm$^2$ (B) Temperature 850° C., load 7.3 kgf/mm$^2$

TEST 2

Thermal shock resistance test

A test piece used was made in the form of a disc ($\phi$50 mm$\times$8 mm thickness) having a hole ($\phi$20 mm) opened therethrough at its center point in the position of 17 mm inside from the peripheral face.

The procedure of heating the test piece at 900° C. for 30 minutes and thereafter cooling the test piece with water at temperature of about 25° C. was prepared. Every time this procedure was repeated 10 times, the length of the crack occurring in the test piece was measured. The resistance to thermal shock was expressed in terms of the number of repetitions when the length of the crack reached 5 mm.

TEST 3

Carburizing resistance test

A test piece used was made in the cylindrical form ($\phi 12 \times 60$ mm in length).

After holding the test piece in a solid carburizer (Durferrit carburizing granulate KG 30, containing $BaCO_3$) at a temperature of 1100° C. for 300 hours, 1 mm-thick surface layer (hereinafter referred to as "layer 1") was removed from the test piece by grinding to obtain particles. The resulting surface of the test piece was further ground to remove another 1 mm-thick layer (to a depth of 2 mm from the original surface, hereinafter referred to as "layer 2") to obtain particles. The particles of each layer were analyzed to determine the C content. The resistance to carburizing is expressed in terms of the increment (%) of the C content. Thus the smaller the value, the smaller is the increment and the higher is the resistance to carburizing.

The results of the foregoing three kinds of tests are listed in Table 2.

TABLE 1

| Spec. No. | Chemical composition of alloy specimens (wt. %) | | | | | | | | | | Remarks |
|---|---|---|---|---|---|---|---|---|---|---|---|
| | C | Si | Mn | Cr | Ni | W | N | Ti | Al | B | |
| 1 | 0.44 | 1.20 | 0.74 | 25.81 | 35.74 | 4.23 | 0.09 | 0.18 | 0.15 | 0.0018 | The invention |
| 2 | 0.44 | 1.17 | 0.67 | 25.56 | 35.10 | 4.27 | 0.08 | 0.19 | 0.17 | 0.0027 | " |
| 3 | 0.45 | 1.27 | 0.75 | 25.89 | 36.01 | 4.17 | 0.09 | 0.10 | 0.12 | 0.0021 | " |
| 4 | 0.44 | 1.20 | 0.70 | 25.61 | 35.27 | 4.33 | 0.09 | 0.08 | 0.10 | 0.0018 | " |
| 5 | 0.41 | 1.21 | 0.72 | 26.17 | 35.41 | 4.57 | — | — | — | — | Comparison |
| 6 | 0.44 | 1.23 | 0.78 | 26.25 | 35.09 | 4.11 | 0.10 | 0.03 | 0.12 | 0.0015 | " |
| 7 | 0.45 | 1.17 | 0.73 | 26.11 | 34.85 | 4.20 | 0.08 | 0.57 | 0.11 | 0.0018 | " |
| 8 | 0.44 | 1.10 | 0.68 | 26.17 | 35.22 | 4.37 | 0.08 | 0.17 | 0.01 | 0.0011 | " |
| 9 | 0.45 | 1.15 | 0.72 | 26.19 | 35.25 | 4.62 | 0.10 | 0.19 | 0.54 | 0.0027 | " |

TABLE 2

| Spec. No. | Test results | | | | | Remarks |
|---|---|---|---|---|---|---|
| | Creep fracture strength ($kgf/mm^2$) | | Resistance to thermal shock | Resistance to carburizing (C content increment, %) | | |
| | Condition(A) | Condition(B) | (times) | Layer 1 | Layer 2 | |
| 1 | 105 | 86 | 180 | 0.90 | 0.47 | Invention |
| 2 | 108 | 91 | 180 | 0.92 | 0.50 | " |
| 3 | 121 | 94 | — | 1.06 | 0.53 | " |
| 4 | 122 | 108 | 170 | 1.08 | 0.57 | " |
| 5 | 76 | 69 | 150 | 1.70 | 0.97 | Comparison |
| 6 | 90 | 77 | 140 | 1.30 | 0.70 | " |
| 7 | 60 | 54 | 100 | 1.10 | 0.59 | " |
| 8 | 94 | 78 | 130 | 1.37 | 0.78 | " |
| 9 | 54 | 51 | 80 | 1.09 | 0.60 | " |

As shown in Table 2, the alloy of this invention has exceedingly higher creep fracture strength at high temperatures than specimen No. 5, i.e. W-containing conventional material which is considered to be excellent in such strength and the other comparison alloys. It is to be noted that high strength of creep fracture is maintained especially even at temperature range above 1000° C. The present iron-nickel-chromium alloy is also superior to the conventional alloy and other comparison steel in respect of resistance to thermal shock.

In the test of resistance to carburizing, the carbon increment is smaller than the conventional alloy (specimen No. 5) by half or less, and is extremely small in comparison with other comparison alloys (specimens No. 6 to No. 9). This is due to synergistic effect of Ti and Al.

The heat resistant cast iron-nickel-chromium alloy of this invention is thus exceedingly superior to the conventional W containing HP materials or the like in respect to high-temperature creep fracture strength and resistance to thermal shock.

Accordingly the present iron-nickel-chromium alloy is well suited as a material for various apparatus and parts for use at temperature above 1000° C., for example, for ethylene cracking tubes and reforming tubes in the petrochemical industry or for hearth rolls and radiant tubes in iron and related industries.

The scope of the invention is not limited to the foregoing description, but various modifications can be made with ease by one skilled in the art without departing from the spirit of the invention. Such modifications are therefore included within the scope of the invention.

What is claimed is:

1. A heat resistant cast iron-nickel-chromium alloy consisting essentially of the following components in the following proportions in terms of % by weight:

C: 0.3–0.6,
$0 < Si \leqq 2.0$,
$0 < Mn \leqq 2.0$,
Cr: 20–30,
Ni: 30–40,
W: 0.5–5.0,
N: 0.04–0.15,
B: 0.0002–0.004,
Ti: 0.04–0.50 and
$0.07 < Al \leqq 0.50$ the balance being substantially Fe.

* * * * *